US010723007B2

(12) United States Patent
Arsenault et al.

(10) Patent No.: US 10,723,007 B2
(45) Date of Patent: Jul. 28, 2020

(54) MODULAR TOOL

(71) Applicants: Brian-keith Bennett Arsenault, St. Augustine, FL (US); Michael Thomas Matthews, St. Augustine, FL (US)

(72) Inventors: Brian-keith Bennett Arsenault, St. Augustine, FL (US); Michael Thomas Matthews, St. Augustine, FL (US)

( * ) Notice: Subject to any disclaimer, the term of this patent is extended or adjusted under 35 U.S.C. 154(b) by 253 days.

(21) Appl. No.: 15/952,485

(22) Filed: Apr. 13, 2018

(65) Prior Publication Data

US 2019/0314972 A1 Oct. 17, 2019

(51) Int. Cl.

| | |
|---|---|
| ***B25F 1/02*** | (2006.01) |
| ***B25F 1/00*** | (2006.01) |
| ***F41B 15/00*** | (2006.01) |

(52) U.S. Cl.

CPC ..... *B25F 1/02* (2013.01); *B25F 1/006* (2013.01); *F41B 15/00* (2013.01)

(58) Field of Classification Search

CPC ..... B25F 1/02; B25F 1/006; F41B 15/00
USPC ..... 7/145
See application file for complete search history.

(56) References Cited

U.S. PATENT DOCUMENTS

| | | | | |
|---|---|---|---|---|
| D353,759 | S * | 12/1994 | Flynn | D8/105 |
| 5,389,033 | A * | 2/1995 | Rauch | A63H 33/009 446/473 |
| 6,976,311 | B2 | 12/2005 | Lee | |
| 8,555,514 | B2 | 10/2013 | Jensen | |
| 9,604,371 | B2 | 3/2017 | Matthews et al. | |
| 10,421,181 | B1 * | 9/2019 | Cox | B25F 1/00 |
| 2012/0023753 | A1 | 2/2012 | Wen | |
| 2013/0227796 | A1 * | 9/2013 | Liao | E04F 21/165 7/170 |
| 2019/0084143 | A1 * | 3/2019 | Bessac | B25F 1/02 |

* cited by examiner

*Primary Examiner* — Hadi Shakeri
(74) *Attorney, Agent, or Firm* — Dunlap, Bennett & Ludwig PLLC

(57) ABSTRACT

A modular tool including a first member and a second member each including a head portion, a shaft portion and a handle portion. The first member includes a first member slot and the second member includes a second member slot. A connector includes fasteners and a pair of locking tabs. Each of the locking tabs includes a pair of locking tab openings. The first member and the second member interlock via the first member slot and the second member slot. The pair of locking tabs are disposed within a pair of locking tab slots and the fasteners run through the pairs of locking tab openings and a pair of member openings, thereby locking the first member to the second member.

15 Claims, 4 Drawing Sheets

MODULAR TOOL

BACKGROUND OF THE INVENTION

The present invention relates to modular tool and, more particularly, to a modular tool with multiple modular handles and head attachments.

SUMMARY OF THE INVENTION

In one aspect of the present invention, a modular tool comprises: a first member comprising a head portion, a shaft portion, a handle portion, and a first member slot running from the handle portion towards the shaft portion; a second member comprising a head portion, a shaft portion, a handle portion, and a second member slot running from the head portion towards the shaft portion, wherein one of the first member and the second member comprises a pair of locking tab slots and the other of the first member and the second member comprises a pair of member openings; and a connector comprising fasteners and a pair of locking tabs each comprising a pair of locking tab openings, wherein the first member and the second member interlock via the first member slot and the second member slot, the pair of locking tabs are disposed within the pair of locking tab slots, and the fasteners run through the pairs of locking tab openings and the pair of member openings, thereby locking the first member to the second member.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
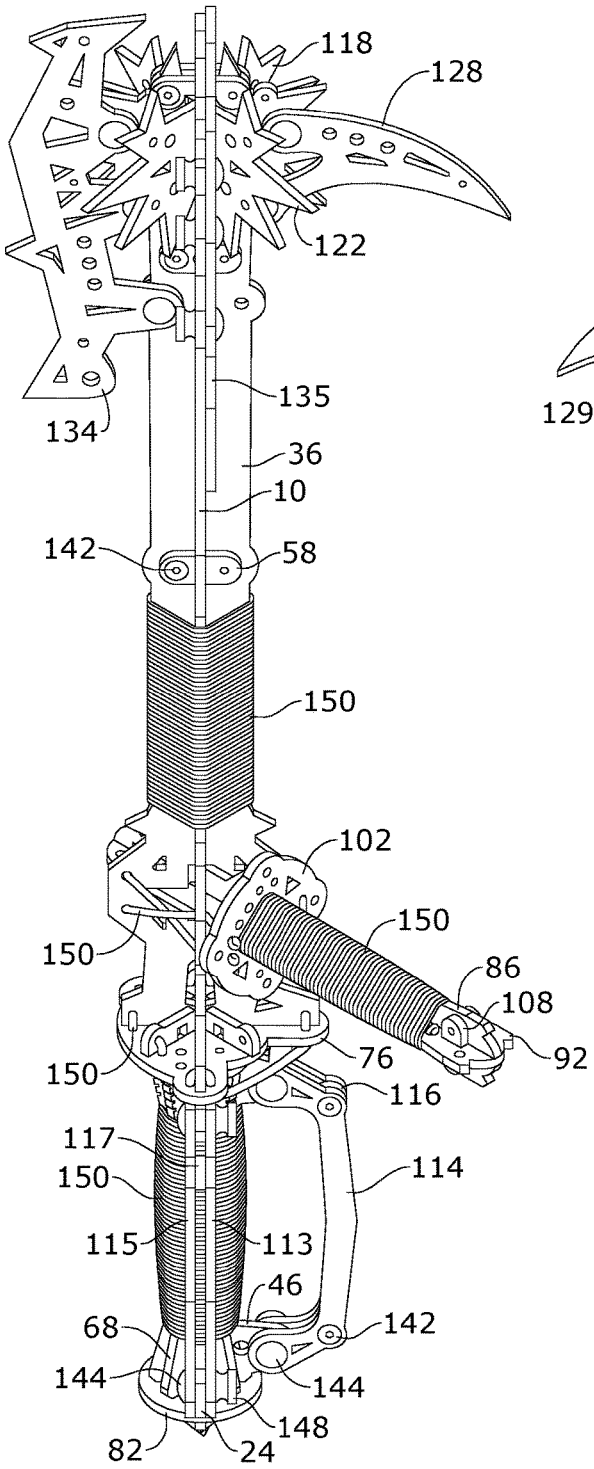
FIG. 1 is a top perspective view of an embodiment of the present invention.
Figure 2:
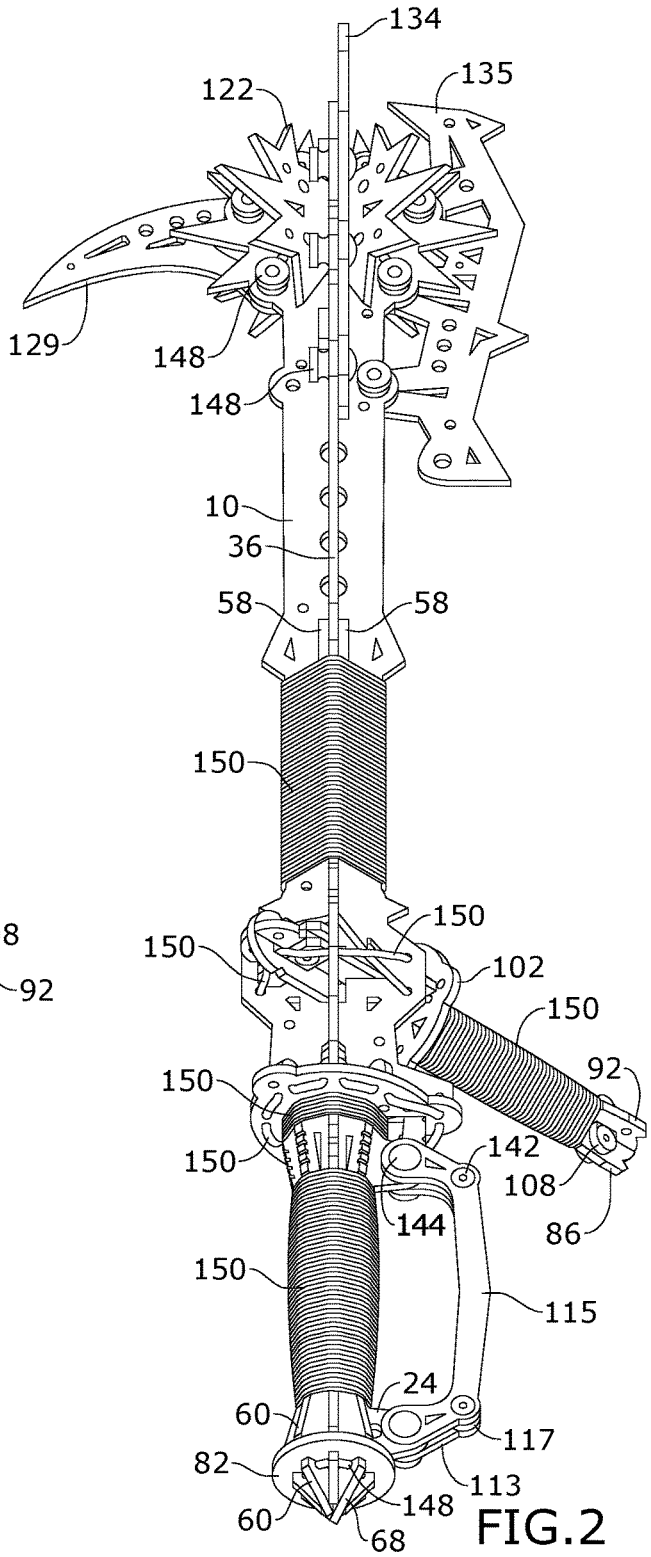
FIG. 2 is a bottom perspective view of an embodiment of the present invention.
Figure 3:
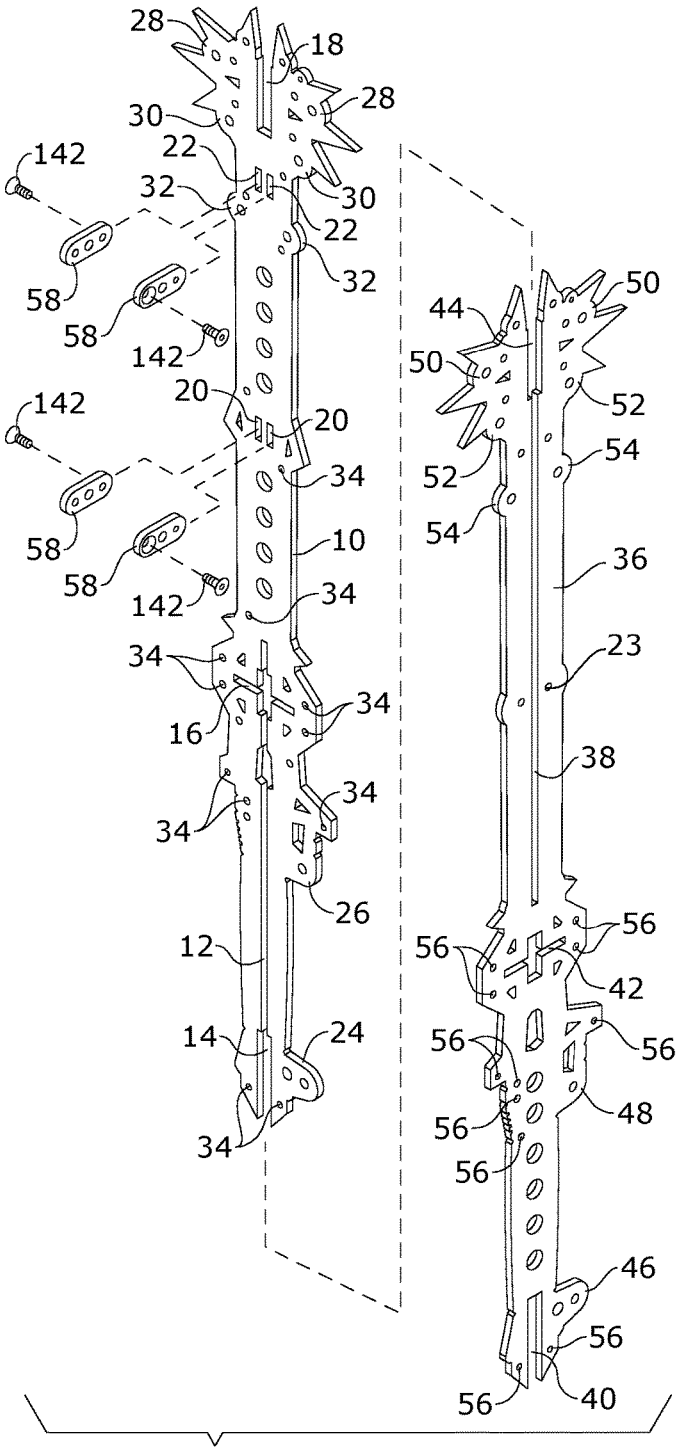
FIG. 3 is an exploded perspective view of a portion of an embodiment of the present invention.
Figure 4:
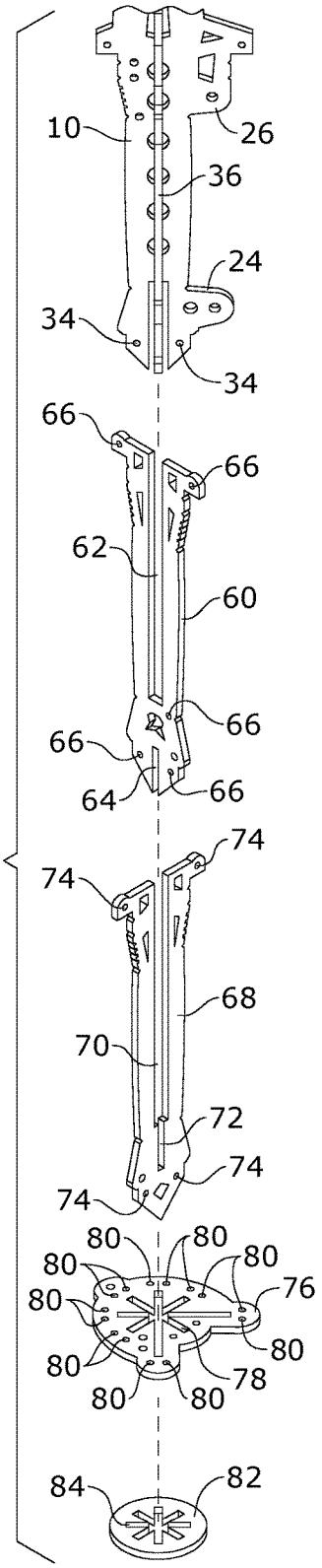
FIG. 4 is an exploded perspective view of a portion of an embodiment of the present invention.
Figure 5:
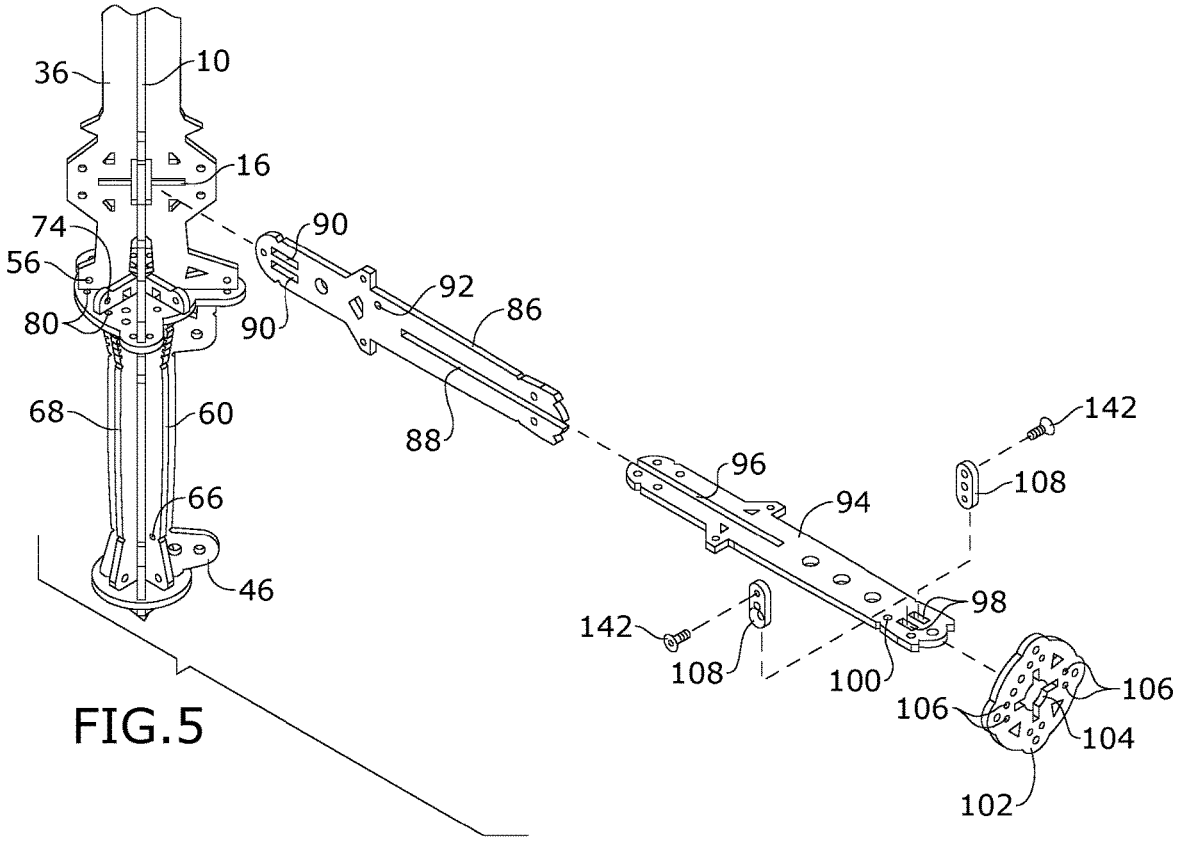
FIG. 5 is an exploded perspective view of a portion of an embodiment of the present invention.
Figure 6:
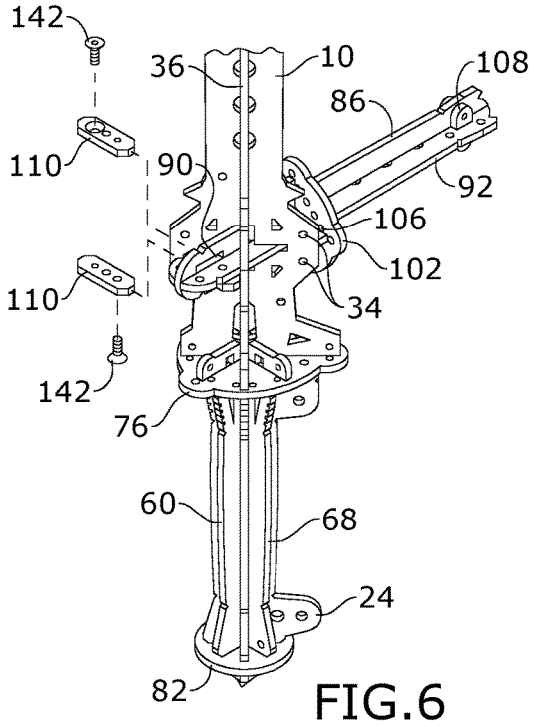
FIG. 6 is an exploded perspective view of a portion of an embodiment of the present invention.
Figure 7:
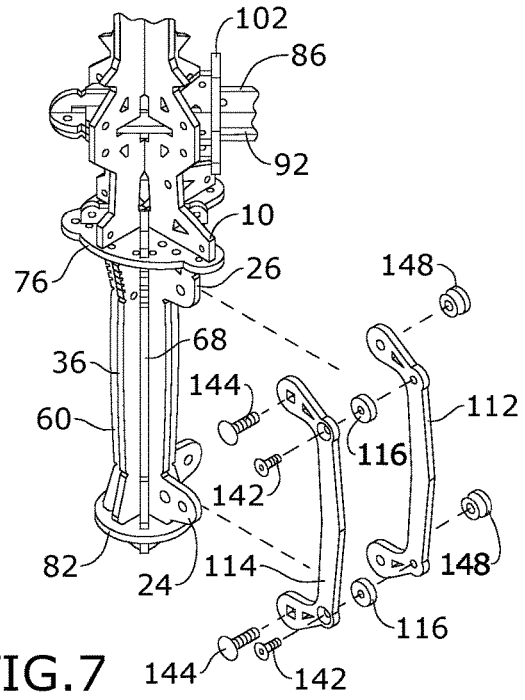
FIG. 7 is an exploded perspective view of a portion of an embodiment of the present invention.
Figure 8:
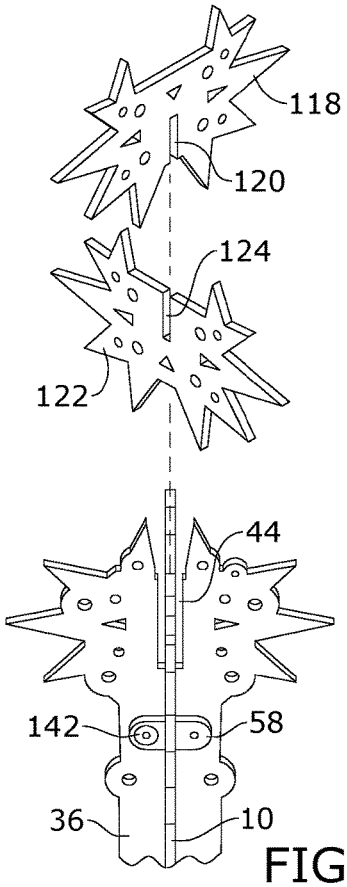
FIG. 8 is an exploded perspective view of a portion of an embodiment of the present invention.
Figure 9:
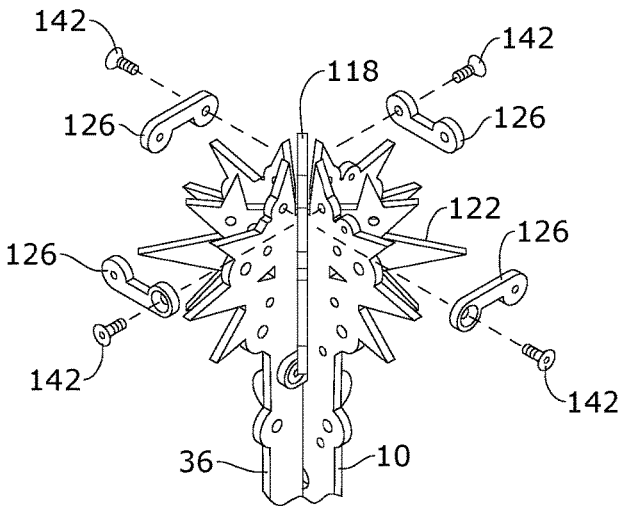
FIG. 9 is an exploded perspective view of a portion of an embodiment of the present invention.
Figure 11:
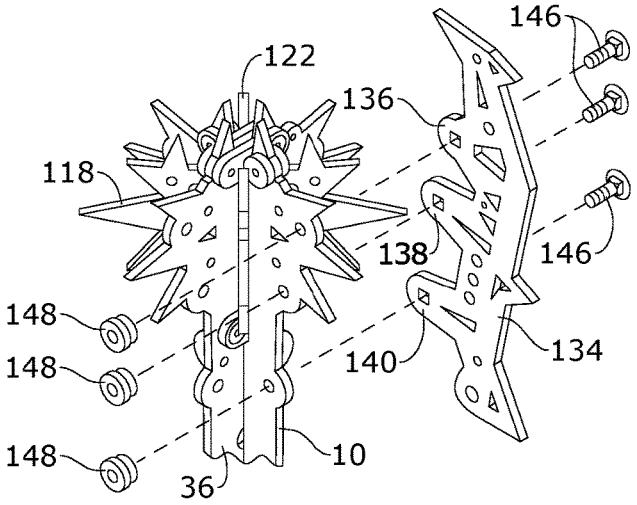
FIG. 11 is an exploded perspective view of a portion of an embodiment of the present invention.
Figure 10:
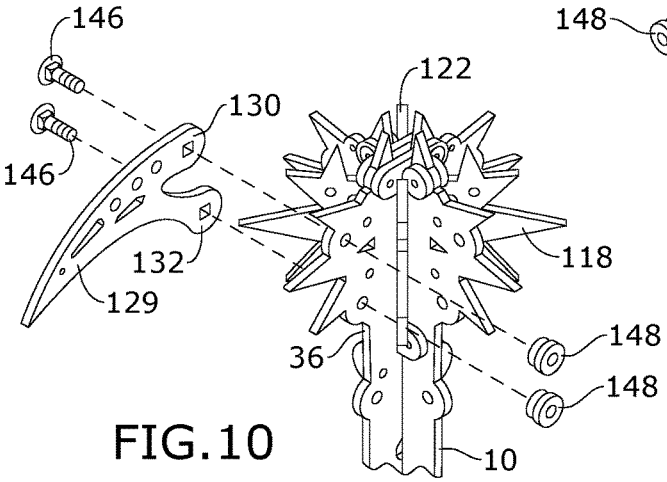
FIG. 10 is an exploded perspective view of a portion of an embodiment of the present invention.

Referring to FIGS. 1 through 11, the present invention includes a modular tool. The modular tool includes a first member 10 and a second member 36 each including a head portion, a shaft portion and a handle portion. The first member 10 includes a first member slot 12 running from the handle portion towards the shaft portion. The second member 36 includes a second member slot 38 running from the head portion towards the shaft portion. One of the first member 10 and the second member 36 includes a pair of locking tab slots 20, 22 and the other of the first member 10 and the second member 36 includes a pair of member openings 23. A connector includes fasteners 142 and a pair of locking tabs 58. Each of the locking tabs 58 includes a pair of locking tab openings. The first member 10 and the second member 36 interlock via the first member slot 12 and the second member slot 38. The pair of locking tabs 58 are disposed within the pair of locking tab slots 22 and the fasteners 142 run through the pairs of locking tab openings and the pair of member openings 23, thereby locking the first member 10 to the second member 36.

Each of the first member 10 and the second member 36 may be elongated plates. When the elongated plates are interlocked, the first member 10 and the second member 36 are substantially perpendicular to one another. In certain embodiments, the first member 10 may include a pair of upper locking tab slots 22 formed in the shaft portion adjacent to and below the head portion and a pair of lower locking tab slots 20 formed in at a mid-section of the shaft portion. A pair of upper locking tabs 58 and a pair of lower locking tabs 58 each include a countersunk opening and a threaded opening. The second member 36 may include two pairs of member openings 23 positioned to align with the upper and lower locking tab slots 22, 20. When the first member 10 and the second member 36 are interlocked, the second member 36 is disposed in between the pair of upper locking tab slots 22 and between the pair of lower locking tab slots 20. The pair of upper locking tabs 58 are disposed within the pair of upper locking tab slots 22 and are thereby disposed on either side of the second member 36. The pair of lower locking tabs 58 are disposed within the pair of lower locking tab slots 20 and are also disposed on either side of the second member 36. The fasteners 142 may be screws. The screws may run through the aligned openings so that the head of the screw is disposed within the countersunk opening and the threaded portion of the screw is mechanically fastened to the threaded openings. A paracord 150 may be wrapped around the first and second members 10, 36 at a lower portion of the shaft portions to provide an additional grip.

The present invention may further include a modular handle. The first member 10 may include a first member handle slot 14 contiguous with the first member slot 12. The first member handle slot 14 may include a greater width than the first member slot 12. The second member 36 includes a second member handle slot 40 running from the handle portion towards the shaft portion. The present invention further includes a first handle member 68 and a second handle member 60 each including a top end and a bottom end. The first handle member 68 includes a first handle member slot 70 running from the top end towards the bottom end and a first bottom slot 72 contiguous with the handle member slot 70. The first bottom slot 72 has a width less than the handle member slot 70. The second handle member 60 includes a second handle member slot 62 running from the top end towards the bottom end and a second bottom slot 64 running from the bottom end towards the top end. The second handle member slot 62 and the second bottom slot 64 are separated. The first handle member 68 interlocks with the second handle member 60 via the first bottom slot 72 and the second bottom slot 64. The first handle member 68 and the second handle member 60 interlock with the handle portions of the first member 10 and the second member 36 via the handle member slots 70, 62, the first member handle slot 14, and the second member handle slot 40. A paracord 150 may also be wrapped around the modular handle.

The present invention may further include an upper plate guard 76 and a lower plate guard 82. The upper plate guard 76 includes a plurality of crisscrossing slots 78 and the lower plate guard 82 includes a plurality of crisscrossing slots 84. The upper plate guard 76 slides up the modular handle via the crisscrossing slots 78 and the lower plate guard 82 is disposed over a bottom end of the modular handle view the crisscrossing slots 84. Connectors releasably secure the upper plate guard 76 and the lower plate guard 82 to the modular handle. For example, the first member 10 may include paracord openings 34 disposed below the lower plate guard 82 and the second member 36 may include paracord openings 56 disposed below the lower plate guard 82. Further, the first handle member 68 may include paracord openings 74 disposed below the lower plate guard 82 and the second handle member 60 may include paracord openings 66 disposed below the lower plate guard 82. A paracord 150 may interweave within the paracord openings 34, 56, 66, 74 and may be tied off to secure the lower plate guard 82 to the modular handle. The first member 10 may include paracord openings 34 disposed above the upper plate guard 76 and the second member 36 may include paracord openings 56 disposed above the upper plate guard 76. Further, the first handle member 68 may include paracord openings 74 disposed above the upper plate guard 76 and the second handle member 60 may include paracord openings 66 disposed above the upper plate guard 76. The upper plate guard 76 may also include paracord openings 80. A paracord 150 may interweave within the paracord openings 34, 56, 66, 74, 80 and may be tied off to secure the upper plate guard 76 to the modular handle.

The present invention may include multiple pairs of handle grip guards 112, 113, 114, 115. In such embodiments, the handle portion of the first member 10 includes a lower protruding tab 24 having a lower protruding tab opening and an upper protruding tab 26 having an upper protruding tab opening. The handle portion of the second member 36 includes a lower protruding tab 46 having a lower protruding tab opening and an upper protruding tab 48 having an upper protruding tab opening. A first pair of handle grip guards 112, 114 includes a right handle grip guard 112 and a left handle grip guard 114. Each of the first pair of handle grip guards 112, 114 includes an upper opening that aligns with the upper tab opening of the first member 10 and a lower opening that aligns with the lower tab opening of the first member 10. Bolts 144 may run through the aligned upper openings and the upper tab opening and the lower openings and the lower tab opening. Thumb nuts 148 mechanically fasten to the bolts 144, thereby connecting the first pair of handle grips guards 112, 114 to the first member 10. The first pair of handle grip guards 112, 114 may also be connected by fasteners 142, such as screws, running through openings and spacers 116 disposed in between the first pair of handle grip guards 112, 114. A second pair of handle grip guards 113, 115 includes a right handle grip 113 and a left handle grip 115. Each of the second pair of handle grip guards 113, 115 includes an upper opening that aligns with the upper tab opening of the second member 36 and a lower opening that aligns with the lower tab opening of the second member 36. Bolts 144 may run through the aligned upper openings and the upper tab opening and the lower openings and the lower tab opening. Thumb nuts 148 mechanically fasten to the bolts 144, thereby connecting the second pair of handle grips guards 113, 115 to the second member 36. The second pair of handle grip guards 113, 115 may also be connected by fasteners 142, such as screws, running through openings and spacers 117 disposed in between the second pair of handle grip guards 113, 115.

The present invention may further include a modular side handle substantially perpendicular relative to the first and second members 10, 36. The modular side handle releasably secures to the first and second members 10, 36 in between the handle portion and the shaft portion. In such embodiments, the first member 10 includes a crisscrossing slot 16 that aligns with a crisscrossing slot 42 of the second member 36. The modular side handle includes a first side handle member 94 and a second side handle member 86 each including a first end and a second end. The first side handle member 94 has a first side handle member slot 96 running from the first end towards the second end. The second side handle member 86 includes a second side handle member slot 88 running from the second end towards the first end. The first side handle member 94 interlocks with the second side handle member 86 via the first and second side handle member slots 96, 88. The first side handle member 94 and the second side handle member 86 interlock with the first and second member 10, 36 via the first ends disposed within the aligned crisscrossing slots 16, 42.

Connectors releasably secure the first and second side handle members 94, 86 to the first and second members 10, 36. For example, the first end of the second side handle member 86 includes locking tab slots 90 and the first end of the first side handle member 94 includes lock openings. Locking tabs 110 having openings may run through the locking tab slots 90. Fasteners 142, such as screws, run through countersunk openings of the locking tabs 110 and the first side handle member and screw into threaded openings of the locking tabs 110. A paracord 150 may wrap around the first and second side handle members 94, 86 and tied off beyond a paracord opening 100 of the first side handle member 94. A paracord 150 may further secure the modular side handle to the first and second members 10, 36 by interweaving through paracord openings 92 of the first and second side handle members 94, 86 and the paracord openings 34, 56 of the first and second members 10, 36.

The present invention may further include a side plate guard 102 for the modular side handle. The side plate guard 102 includes crisscrossing slots 104 slidably engaged with the first and second side handle members 94, 86. Connectors releasably secure the side plate guard 102 to the first and second side handle members 94, 86. For example, the side plate guard 102 includes paracord openings 106. A paracord 150 may interweave through the paracord openings 92 of the first and second side handle members 94, 86, the paracord openings 106 of the side plate guard, and the paracord openings 34, 56 of the first and second members 10, 36.

The second ends of the first and second side handle members 94, 86 may also be releasably connected to provide additional stability. For example, the second end of the first side handle member 94 includes locking tab slots 98 and the second end of the second side handle member 86 includes lock openings. Locking tabs 108 having openings may run through the locking tab slots 98. Fasteners 142, such as screws, run through countersunk openings of the locking tabs 108, through the lock openings of the second side handle member 86 and screw into threaded openings of the locking tabs 108.

The present invention may be used as a morning star weapon. For example, the head portions of the first and second members 10, 36 may include radially protruding spikes. To add to the spikes, the present invention may further include head attachments with additional radially protruding spikes. In such embodiments, the first member 10 includes a first member head slot 18 running from the head portion towards the shaft portion and the second member 36 includes a second member head slot 44 running from the head portion towards the shaft portion. The second member head slot 44 may be contiguous with the second member slot 38 and may include a greater width than the second member slot 38. The head attachments may include a first head member 122 and a second head member 118 each including a top end and a bottom end. The first head member 122 includes a first head member slot 124 running from the top end towards the bottom end. The second head member 118 includes a second head member slot 120 running from the bottom end towards the top end. The first head member 122 interlocks with the second head member 118 via the first and second head member slots 124, 120, and the first and second head members 122, 118 interlock with the head portions of the first member 10 and the second member 36 via the bottom ends of the first and second head members 122, 118 disposed within the first and second member head slots 18, 44. Connectors releasably secure the first and second head members 122, 118 to the first and second members 10, 36. For example, the connectors include locking tabs 126 each having a countersunk opening and a threaded opening. A plurality of fasteners 142, such as screws, run through the countersunk openings, through aligned openings of either the head portions of the first and second members 10, 36 or aligned openings of the first and second head members 122, 118 and screw into the threaded openings of the locking tabs 126.

The present invention may further include hook attachments 128, 129 and axe head attachments 134, 135. A first hook attachment 128 may releasably connect with the head portion of the second member 36, a second hook attachment 129 may releasably connect with the head portion of the first member 10, a first axe head attachment 134 may releasably connect with the head portion of the second member 36, and a second axe head attachment 135 may releasably connect with the head portion of the first member 10. In such embodiments, the head portion of the first member 10 may include upper protruding tabs 28 extending from opposing sides, middle protruding tabs 30 extending from opposing sides, and lower protruding tabs 32 extending from opposing sides. Further, the head portion of the second member 36 may include upper protruding tabs 50 extending from opposing sides, middle protruding tabs 52 extending from opposing sides, and lower protruding tabs 54 extending from opposing sides. Each of the protruding tabs 28, 30, 32, 50, 52, 54 includes openings. Each of the axe head attachments 134, 135 may also include an upper protruding tab 136, a middle protruding tab 138, and a lower protruding tabs 140 each including openings. The openings of the protruding tabs 136, 138, 140 of the axe head attachments 134, 135 align with the openings of the protruding tabs 28, 30, 32, 50, 52, 54 of either of the first and second members 10, 36. Bolts 146 run through the openings and thumb nuts 148 mechanically fasten to threaded ends of the bolts 146, thereby securing the axe head attachments 134, 135 to the first and second members 10, 36. Each of the hook attachments 128, 129 include an upper protruding tab 130 and a lower protruding tab 132 each including openings. The openings of the protruding tabs 130, 132 align with the openings of the protruding tabs 28, 30, 32, 50, 52, 54. Bolts 146 run through the openings and thumb nuts 148 mechanically fasten to threaded ends of the bolts 146, thereby securing the hook attachments 128, 129 to the first and second members 10, 36.

It should be understood, of course, that the foregoing relates to exemplary embodiments of the invention and that modifications may be made without departing from the spirit and scope of the invention as set forth in the following claims.

What is claimed is:

1. A modular tool comprising:

a first member comprising a head portion, a shaft portion, a handle portion, and a first member slot running from the handle portion towards the shaft portion;

a second member comprising a head portion, a shaft portion, a handle portion, and a second member slot running from the head portion towards the shaft portion, wherein one of the first member and the second member comprises a pair of locking tab slots and the other of the first member and the second member comprises a pair of member openings; and a connector comprising fasteners and a pair of locking tabs each comprising a pair of locking tab openings, wherein the first member and the second member interlock via the first member slot and the second member slot, the pair of locking tabs are disposed within the pair of locking tab slots, the fasteners run through the pairs of locking tab openings and the pair of member openings, thereby locking the first member to the second member; and a paracord wrapped around the first and second members at a lower portion of the shaft portions.

2. The modular tool of claim 1, wherein the first member comprises a first member handle slot contiguous with the first member slot, wherein the first member handle slot comprises a greater width than the first member slot, and the second member comprises a second member handle slot running from the handle portion towards the shaft portion.

3. The modular tool of claim 2, further comprising a first handle member and a second handle member, each comprising a top end, a bottom end, and a handle member slot running from the top end towards the bottom end, wherein the first handle member comprises a first bottom slot contiguous with the handle member slot, wherein the first bottom slot comprises a width less than the handle member slot, and the second handle member comprises a second bottom slot running from the bottom end towards the top end, wherein the first handle member interlocks with the second handle member via the first bottom slot and the second bottom slot and the first handle member and the second handle member interlock with the handle portions of the first member and the second member via the handle member slots, the first member handle slot, and the second member handle slot.

4. The modular tool of claim 3, further comprising an upper plate guard and a lower plate guard each comprising a plurality of crisscrossing slots slidably engaged with the first handle member, the second handle member, the handle portion of the first member and the handle portion of the second member, wherein connectors releasably secures the upper plate guard and the lower plate guard to the handle portions.

5. The modular tool of claim 3, wherein at least one of the first member and the second member comprises an upper protruding tab comprising an upper tab opening and a lower protruding tab comprising a lower tab opening.

6. The modular tool of claim 5, further comprising a pair of handle grip guards each comprising an upper opening that aligns with the upper tab opening and a lower opening that aligns with the lower tab opening, wherein fasteners are disposed through the aligned upper openings and the upper tab opening and the lower openings and the lower tab opening.

7. The modular tool of claim 3, further comprising a paracord wrapped around the first handle member, the second handle member, the handle portion of the first member and the handle portion of the second member.

8. The modular tool of claim 1, wherein the first member and the second member each comprise aligned crisscrossing slots in between the handle portions and the shaft portions.

9. The modular tool of claim 8, further comprising a first side handle member comprising a first end, a second end, and a first side handle member slot running from the first end towards the second end, and a second side handle member comprising a first end, a second end, and a second side handle member slot running from the second end towards the first end, wherein the first side handle member interlocks with the second side handle member via the first and second side handle member slots, and the first side handle member and the second side handle member interlock with the first and second member via the first ends disposed within the aligned crisscrossing slots, wherein connectors releasably secure the first and second side handle members to the first and second members.

10. The modular tool of claim 9, further comprising a side plate guard comprising crisscrossing slots slidably engaged with the first and second side handle members, wherein connectors releasably secure the side plate guard to the first and second side handle members.

11. The modular tool of claim 9, further comprising a paracord wrapped around the first and second side handle members.

12. The modular tool of claim 1, wherein the first member comprises a first member head slot running from the head portion towards the shaft portion and the second member comprises a second member head slot running from the head portion towards the shaft portion and contiguous with the second member slot, wherein the second member head slot comprises a greater width than the second member slot.

13. The modular tool of claim 12, further comprising a first head member comprising a top end, a bottom end, and a first head member slot running from the top end towards the bottom end, and a second head member comprising a top end, a bottom end, and a second head member slot running from the bottom end towards the top end, wherein the first head member interlocks with the second head member via the first and second head member slots, and the first and second head members interlock with the head portions of the first member and the second member via the bottom ends disposed within the first and second member head slots, wherein connectors releasably secure the first and second head members to the first and second members.

14. The modular tool of claim 1, wherein the head portions of the first member and second member each comprise upper protruding tabs and lower protruding tabs, wherein the upper protruding tabs each comprise an upper tab opening and the lower protruding tabs each comprise a lower tab opening.

15. The modular tool of claim 14, further comprising at least one axe head attachment and at least one hook attachment, wherein each of the at least one axe head attachment and the at least one hook attachment comprise an upper opening that aligns with the upper tab openings and a lower opening that aligns with the lower tab openings, wherein fasteners are disposed through the aligned upper openings and the upper tab opening and the lower openings and the lower tab opening.

* * * * *